United States Patent [19]

Bowen, Jr. et al.

[11] 4,121,569

[45] Oct. 24, 1978

[54] VENTING AND RECIRCULATING VENT KITCHEN HOOD

[75] Inventors: Leon O. Bowen, Jr.; Michael T. McVean, both of Cleburne, Tex.

[73] Assignee: Rangaire Corporation, Cleburne, Tex.

[21] Appl. No.: 836,213

[22] Filed: Sep. 23, 1977

Related U.S. Application Data

[62] Division of Ser. No. 700,216, Jun. 28, 1976, Pat. No. 4,088,123.

[51] Int. Cl.[2] ..... F24C 15/08; F23J 11/00

[52] U.S. Cl. ..... 126/299 D; 55/DIG. 36

[58] Field of Search ..... 126/299 D; 55/DIG. 36

[56] References Cited

U.S. PATENT DOCUMENTS

| | | | |
|---|---|---|---|
| 2,886,124 | 5/1959 | Scharmer | 126/299 D |
| 3,521,548 | 7/1970 | Doane | 126/299 D |

*Primary Examiner*—Ronald C. Capossela

*Attorney, Agent, or Firm*—Richards, Harris & Medlock

[57] ABSTRACT

The specification discloses a kitchen stove hood having two venting modes of operation. The kitchen stove hood is dimensioned to be disposed in a kitchen area over a stove and includes an air intake opening. An air recirculation outlet for recirculating filtered air to the kitchen area and an air vent outlet for venting air from the kitchen area is also included in the kitchen stove hood. A recirculation damper blade is mounted adjacent to the air recirculation outlet and is operable between an open and closed position. A vent damper blade is mounted adjacent to the air vent outlet and is operable between an open and closed position. The damper blades are interconnected by a damper blade linkage assembly which is operable to positively move the recirculation damper blade between its open and closed position while simultaneously moving the vent damper blade between its closed and open position. When the recirculation damper blade is open, the vent damper blade is closed thereby recirculating air to the kitchen. When the recirculation damper blade is closed, the vent damper blade is open to vent air outside the kitchen area.

2 Claims, 27 Drawing Figures

FIG. 4
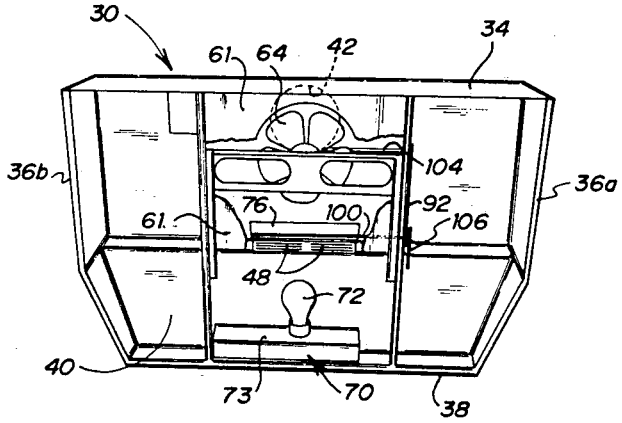
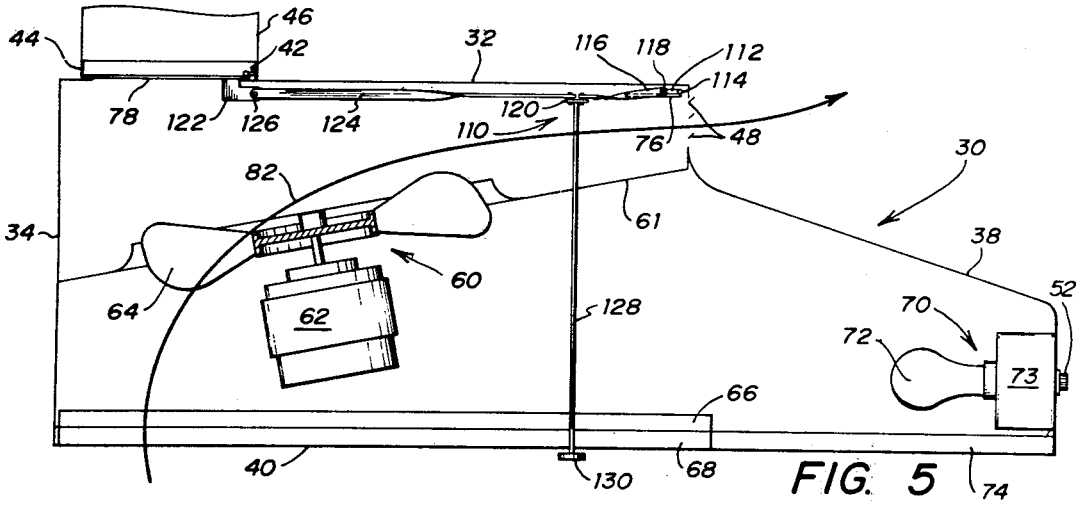
FIG. 5
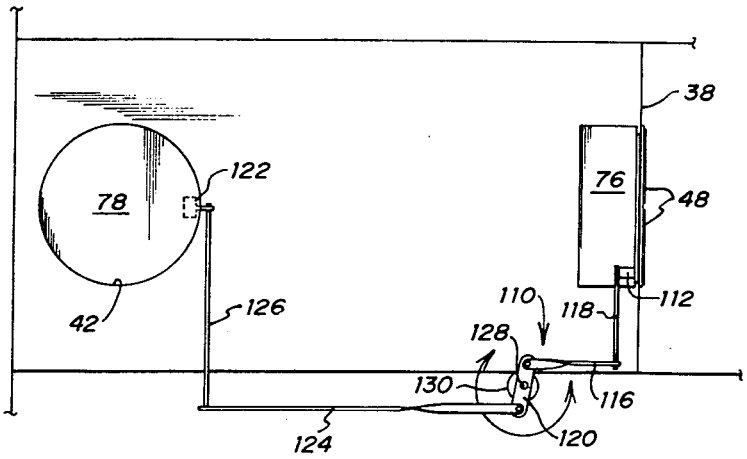
FIG. 6

FIG. 17
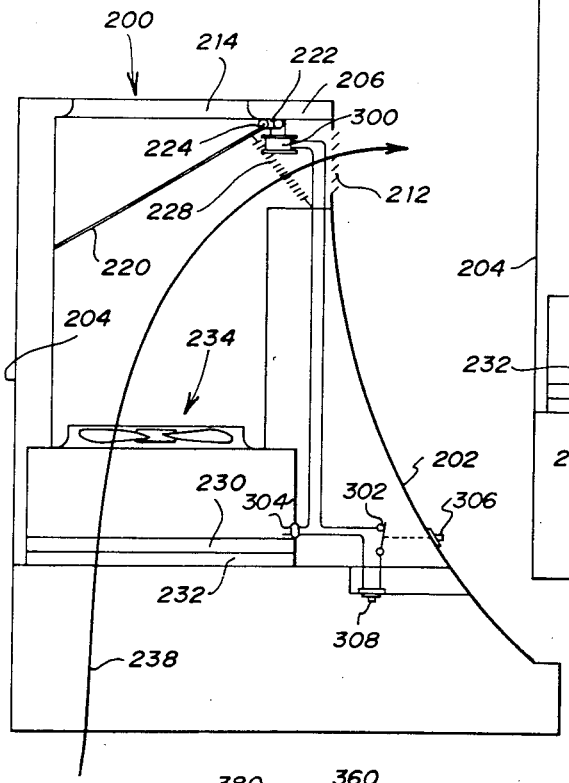
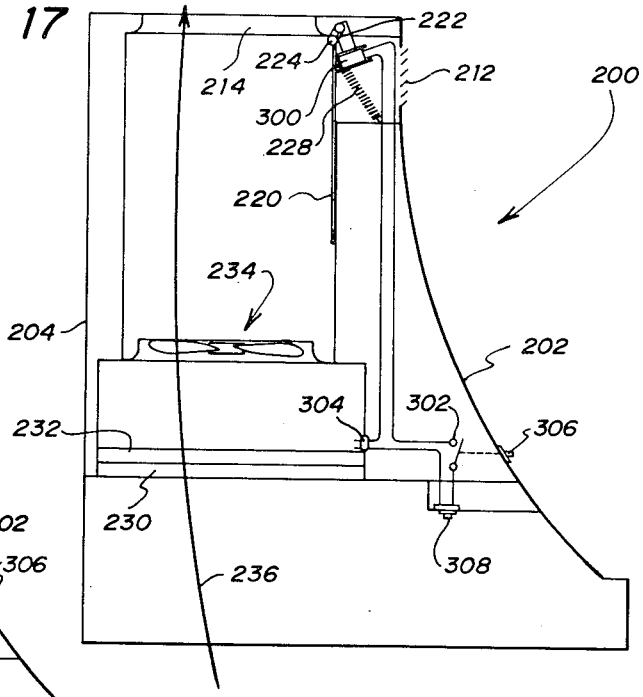
FIG. 18
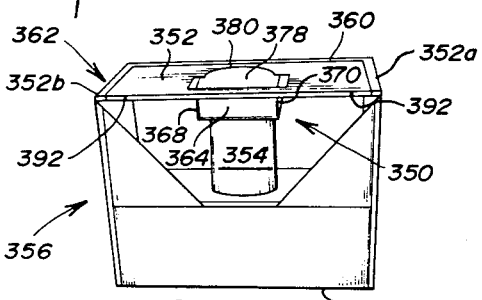
FIG. 19
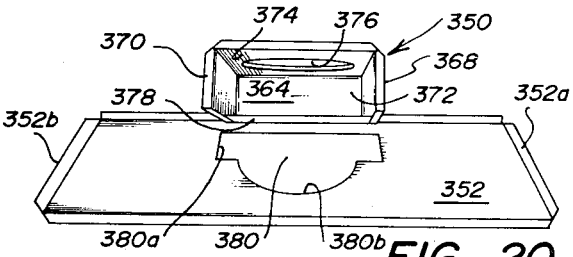
FIG. 20
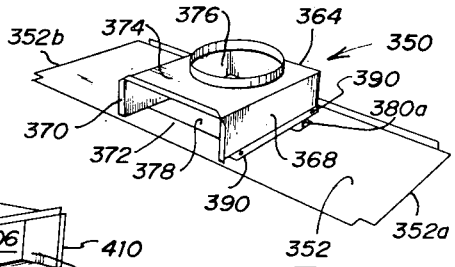
FIG. 21
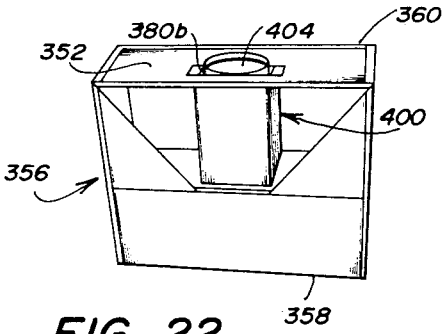
FIG. 22
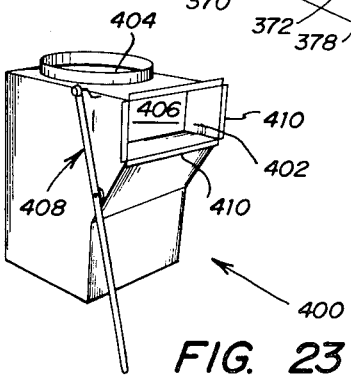
FIG. 23

VENTING AND RECIRCULATING VENT KITCHEN HOOD

This is a division of application Ser. No. 700,216, filed June 28, 1976 now U.S. Pat. No. 4,088,123.

FIELD OF THE INVENTION

Ths invention relates to kitchen stove hoods, and more particularly relates to a kitchen stove hood having two modes of venting.

THE PRIOR ART

Kitchen stove hoods are typically used to collect odors and heat generated in the use of a kitchen stove and to exhaust the heat and odors exterior of the kitchen area. However, it is desirable during winter months to recirculate the heated air into the kitchen area to reduce heating costs and conserve energy. A need has thus arisen for a kitchen stove hood which includes both summer and winter modes of operation, along with reliable and efficient structure that enables every conversion of the hood between modes.

A hood system has been heretofore described in U.S. Pat. No. 2,886,124 by G. A. Scharmer, issued May 12, 1959, which includes venting and recirculation modes. However, no structure is disclosed in the Scharmer patent which enables positive simultaneous opening and closing of damper blades, nor the use of simplified single damper systems to provide improved operating conditions.

SUMMARY OF THE INVENTION

The present invention substantially eliminates and reduces the problems heretofore associated with prior art devices.

In accordance with the present invention, a kitchen stove hood for selectively providing air ventilation or recirculation in a kitchen area comprises a hood dimensioned to be disposed in the kitchen area over a stove. The hood includes an air intake opening and a fan for causing air from the kitchen area to flow through the air intake opening. An air recirculation outlet for recirculating air to the kitchen area and an air vent outlet for venting air from the kitchen area are also included in the hood. A recirculation damper blade is mounted adjacent the air recirculation outlet and is operable to move between an open and closed position. A vent damper blade is mounted adjacent the air vent outlet and is operable to move between an open and closed position. Structure is provided for interconnecting the damper blades and is operable to positively move the recirculation damper blade between its open and closed positions, while simultaneously moving the vent damper blade between its closed and open positions. When the recirculation damper blade is open, the vent damper blade is closed thereby recirculating the air to the kitchen area. When the recirculation damper blade is closed, the vent damper blade is open to vent air outside the kitchen area.

In accordance with another aspect of the invention, a kitchen stove hood for selectively providing air ventilation or recirculation in a kitchen area includes a hood dimensioned to be disposed in the kitchen area over a stove. The hood includes an air intake opening and a fan for causing air from the kitchen area to flow through the air intake opening. The hood also includes an air recirculation outlet for recirculating air to the kitchen area and an air vent outlet for venting air from the kitchen area. A damper blade is mounted for movement between a first position adjacent the recirculation outlet and a second position adjacent the vent outlet for selectively opening and closing the outlets. Structure is provided to move the damper blade between the first and second positions. When the damper blade is in the first position the recirculation outlet is closed and the vent outlet is open, thereby venting air outside the kitchen area. When the damper blade is in the second position the recirculation outlet is open and the vent outlet is closed, thereby recirculating air into the kitchen area.

In accordance with yet another aspect of the invention, a kitchen stove hood includes an air intake opening and a fan for causing air from the kitchen area to flow through the air intake opening. The hood further includes an upper vent outlet and a front recirculation outlet. A housing is adapted to be received in the upper portion of the hood for alternatively blocking the top vent outlet to establish air flow between the air intake opening and the front recirculation outlet. The housing may also be installed for blocking the front recirculation outlet to establish an air flow between the air intake opening and the upper vent outlet.

DESCRIPTION OF THE DRAWINGS

For a more detailed explanation of the present invention and for further objects and advantages thereof, reference is now made to the following detailed description taken in conjunction with the accompanying drawings, in which:

FIG. 4 is a bottom plan view of the kitchen stove hood of FIG. 1;

FIG. 5 is a side elevation view in section of the kitchen stove hood of FIG. 1 utilizing a second embodiment of the damper blade linkage assembly illustrating the winter mode of operation;

FIG. 6 is a partial top plan view of the kitchen hood of FIG. 5;

FIG. 17 is a side elevation view in section of the kitchen stove hood of FIG. 10 utilizing a fourth embodiment of the damper blade control illustrating the summer mode of operation;

FIG. 18 is a side elevation view in section of the kitchen stove hood of FIG. 17 illustrating the winter mode of operation;

FIG. 19 illustrates a kitchen stove hood conversion kit according to the present invention;

FIG. 20 is an exploded view of the vent closure member of the conversion kit of FIG. 19;

FIG. 21 is a perspective view of the vent closure member of FIG. 20;

FIG. 22 is a perspective view of a second embodiment of a kitchen stove hood conversion kit;

FIG. 23 is a view of the dual mode housing used with the conversion kit shown in FIG. 22;

DESCRIPTION OF THE PREFERRED EMBODIMENT

Figure 1:
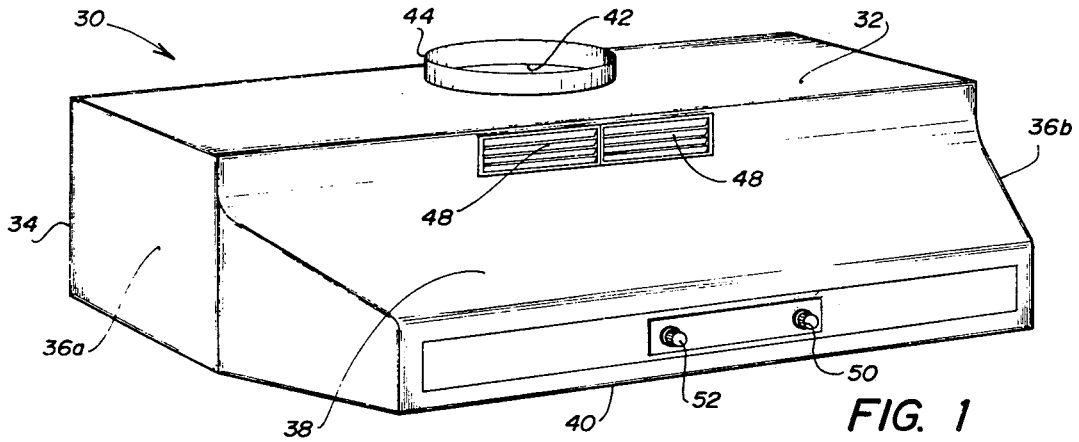
FIG. 1 is a perspective view of a first embodiment of the kitchen stove hood of the present invention.

FIG. 1 illustrates a preferred embodiment of the present venting and recirculation kitchen stove hood. The hood is identified generally by the numeral 30 and includes a top portion 32, rear portion 34, sides 36*a* and 36*b*, a front portion 38 and a bottom portion 40. The hood 30 is dimensioned to be disposed in a kitchen area over a stove so that the bottom portion 40 is aligned to receive the heat and odors generated through use of the stove.

Located in the top portion 32 of hood 30 is an air vent outlet 42. Although air vent outlet 42 is shown to be circular in shape, in the alternative a rectangular outlet can be used. A connecting ring 44 is formed in the top portion 32 of hood 30 and is used to connect the vent outlet 42 to the exhaust ventiliation ducts 46 (FIG. 2) of the kitchen. The front portion 38 of hood 30 includes air recirculation outlets 48, which direct air into the kitchen area. The hood 30 also includes a motor speed control switch 50 and a light switch 52.

It can be seen that hood 30 provides two possible air flow paths. One path allows air to flow from the stove through the bottom portion 40 of hood 30 and exit from the air vent outlet 42 to be removed from the kitchen via the exhaust ductwork. The second path permits air to flow from above the stove through the bottom portion 40 of hood 30 and exit through the recirculation outlets 48 to the kitchen area in order to conserve heat.

Figure 2:
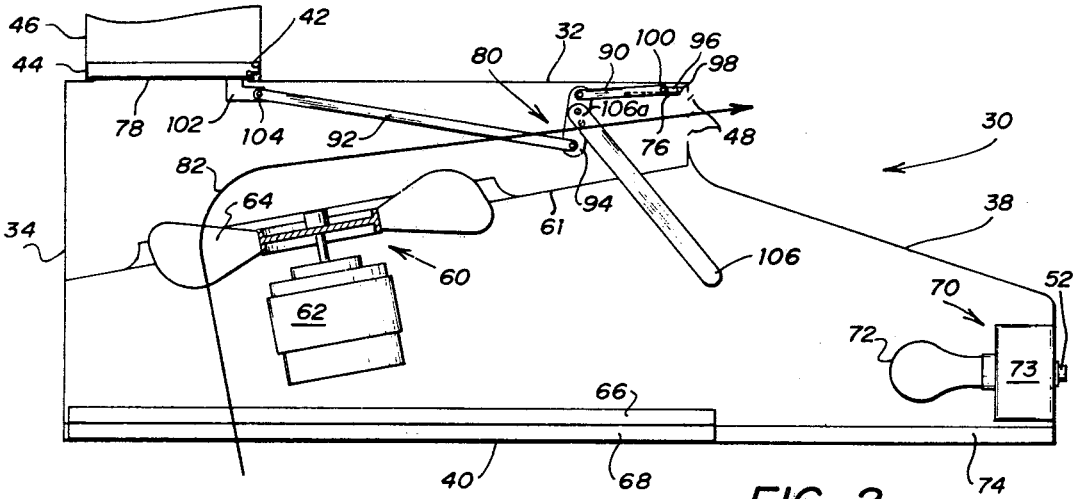
FIG. 2 is a side elevation view in section of the kitchen stove hood of FIG. 1 utilizing a first embodiment of a damper blade linkage assembly illustrating the winter mode of operation.
Figure 3:
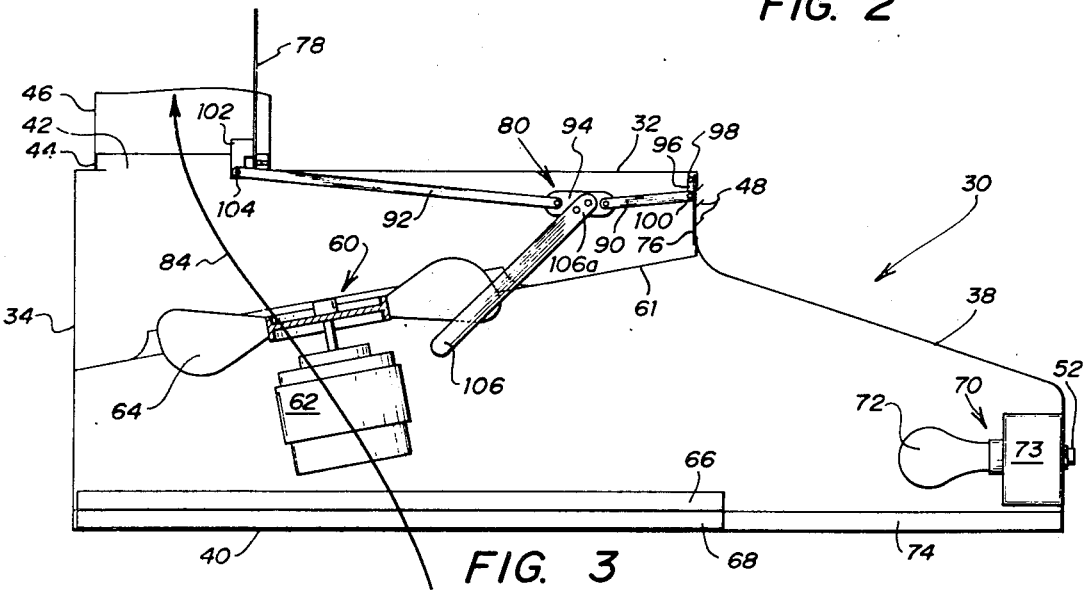
FIG. 3 is a side elevation view in section of the kitchen stove hood of FIG. 1 illustrating the summer mode of operation.

Referring simultaneously to FIGS. 2, 3 and 4, the interior portion of hood 30 is illustrated, wherein like numerals are used for like and corresponding elements throughout the specification. Hood 30 includes a fan assembly 60 mounted centrally therein and an air divider panel 61. Fan assembly 60 includes a motor 62 which is controlled by the motor speed control 50 (FIG. 1) located on the front portion 38 of hood 30. Motor 62 drives an air moving blade 64, which when rotating draws air up through the panel 61 and through filter elements 66 and 68 mounted in the lower portion 40 of hood 30. Filters 66 and 68 may be made of aluminum and activated charcoal and act to filter the air drawn into the hood 30 before the air is recirculated to the kitchen area or vented from the kitchen. Filters 66 and 68 are removable for cleaning and replacement as illustrated in FIG. 4. Hood 30 also includes a light assembly 70 mounted within the interior of hood 30 and includes a bulb 72, socket 73 and lens 74.

Pivotally mounted adjacent to the air recirculation outlet 48 and interior of the housing 30 is a recirculation damper blade 76, which is operable to block the air recirculation outlet 48 and prevent air from being recirculated into the kitchen area. Similarly, a vent damper blade 78 is pivotally mounted adjacent to the air vent outlet 42 and is operable to block the passage of air through vent outlet 42. Interconnecting recirculation damper blade 76 and vent damper blade 78 is a damper blade linkage assembly 80. Linkage assembly 80 is operable to positively move the recirculation damper blade 76 between its open position, shown in FIG. 2, and its closed position shown in FIG. 3, while simultaneously moving the vent damper blade 78 between its closed position shown in FIG. 2 and its open position shown in FIG. 3.

FIG. 2 illustrates the position of the damper blades in the energy saving winter mode, wherein the recirculation damper blade 76 is in its open position and the vent damper blade 78 is in its closed position. The warm air from the kitchen stove is filtered through filters 66 and 68 and then recirculated to the kitchen through air recirculation outlet 48 to add filtered warm air to the kitchen, thereby decreasing winter heating costs. The winter mode of operation air flow pattern is indicated by path 82 (FIG. 2). The summer mode of operation of hood 30 is illustrated in FIG. 3. The recirculation damper blade 76 is in its closed position, blocking the air recirculation outlet 48. The vent damper blade 78 is in its open position to permit hot air from the kitchen stove to vent from the kitchen through air vent outlet 42. In this mode of operation the air follows the air flow pattern designated as 84 and the hot air is discharged externally of the kitchen to cool the kitchen and reduce the air conditioning costs during the summer months.

The damper blade linkage assembly 80 includes links 90 and 92, which are interconnected to a lever 94. Recirculation damper blade 76 is rotatably mounted to link 90 using lever arm 96. Lever arm 96 is mounted to recirculation damper blade 76 along a rod 98. The second end of lever arm 96 is mounted to a rod 100, more clearly shown in FIG. 4, and lever arm 96 is also rotatably mounted to one end of link 90. The second end of link 90 is rotatably connected to lever 94.

A bracket 102 is rigidly mounted at one end to the vent damper blade 78. The second end of bracket 102 is rotatably mounted to one end of link 92 using a rod 104, which is more clearly shown in FIG. 4. The second end of link 92 is interconnected for rotatable motion to lever 94. A link 106 is rigidly connected at its upper end 106*a* to the central portion of lever 94.

Damper blade linkage assembly 80 is operated by moving link 106 from its winter position illustrated in FIG. 2 to the summer position illustrated in FIG. 3. In FIG. 2, link 106 is in its forwardmost position such that lever 94 has its longitudinal axis substantially perpendicular to the top portion 32 of hood 30. In this winter vent position, recirculation damper blade 76 is in its open position and vent damper blade 78 is in its closed position.

To transform the hood 30 from its winter mode (FIG. 2) to the summer mode of FIG. 3, the operator reaches into the interior of hood 30 and grasps link 106 and pushes it laterally rearward. This rearward motion causes lever 94 to rotate to a position in which its longitudinal axis is substantially parallel to the top portion 32 of hood 30. This rotation simultaneously rotates recirculation damper blade 76 to its closed position, thereby blocking recirculation outlet 48 and simultaneously rotating vent damper blade upward to open air vent outlet 42. The simultaneous movement of closing recirculation damper 76 and opening vent damper 78 is accomplished by the forward movement of link 90, while link 92 moves rearwardly.

To reverse the modes of operation, the operator merely pulls link 106 to its forwardmost position, thus simultaneously closing the vent damper blade 78 and opening the recirculation damper blade 76. This action changes the air flow pattern from that indicated by path 84 (FIG. 3) back to the air flow pattern indicated by path 82 (FIG. 2).

Referring simultaneously to FIGS. 5 and 6, wherein like numerals are used for like and corresponding elements, a second embodiment of a damper blade linkage assembly 110 is illustrated. Damper blade linkage assembly 110 interconnects the recirculation damper blade 76 and the vent damper blade 78 and is operable to simultaneously open the recirculation damper blade 76 while closing the vent damper blade 78. Alternatively, the linkage 110 may be operable to simultaneously open vent damper blade 78 and close recirculation damper blade 76 in a manner similar to that previously described.

Damper blade linkage assembly 110 includes a lever arm 112, which is interconnected to recirculation damper blade 76 using a rod 114. The second end of lever arm 112 is interconnected for rotatable motion to a link 116 using rod 118. The second end of link 116 is rotatably connected to a lever 120. The damper blade linkage assembly 110 further includes a bracket 122 rigidly mounted to vent damper blade 78 and rotatably mounted to a link 124 by a rod 126. The second end of link 124 is rotatably interconnected to lever 120. Lever 120 is interconnected to a vertical shaft 128, which extends from lever 20 at the upper portion of hood 30 to a location extending from below bottom portion 40 of hood 30. Shaft 128 terminates in a handle member 130, which is accessible to the hood operator.

In operation of the damper blade linkage assembly 110, the operator rotates handle 130 either clockwise or counterclockwise to place the damper blades in either the winter or summer mode. FIGS. 5 and 6 illustrate the hood in the winter mode with an air flow pattern 82 recirculating filtered warm air to the kitchen. To place the damper blades in the summer mode, the operator rotates handle 130 clockwise. This rotates shaft 128, causing link 126 to move rearwardly in the hood 30 to rotate the vent dampr blade 78 upwardly to open vent outlet 42. Simultaneous with the rearward motion of link 126, link 116 will be moved forward in the hood 30. This movement will rotate the recirculation damper blade downwardly to block the air recirculation outlet 48 and blocking the air flow to the kitchen. To return the damper blades to the winter mode, the operator turns handle 130 counterclockwise, thereby closing vent damper blade 78 while simultaneously opening recirculation damper blade 76.

Figure 7:
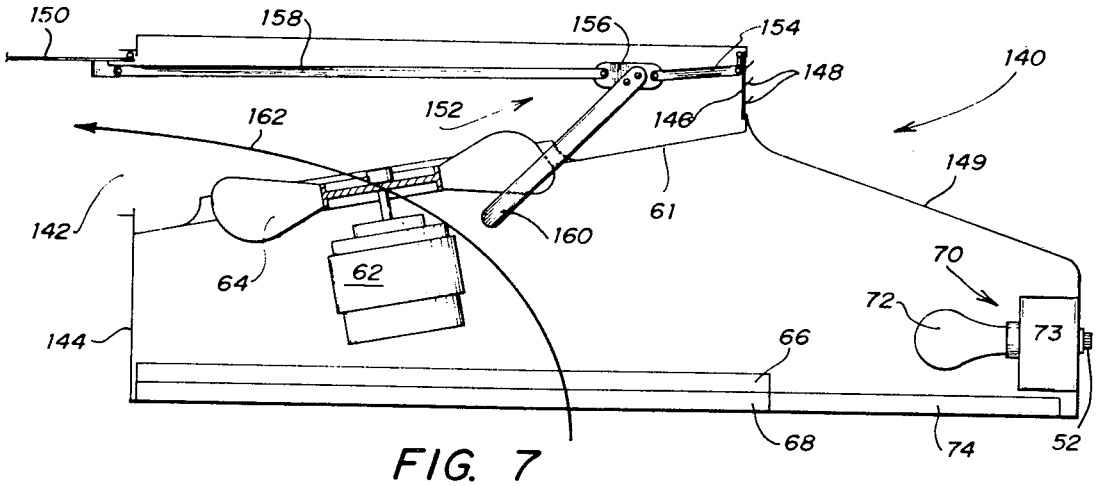
FIG. 7 is a side elevation view in section of a second embodiment of a kitchen stove hood of the present invention.

Referring now to FIG. 7, a second embodiment of the kitchen hood of the present invention is illustrated and generally referred to by the numeral 140. Hood 140 is similar in shape to hood 30 previously discussed. However, an air vent outlet 142 is located in the rear portion 144 instead of the top portion as is the case with kitchen hood 30. Kitchen hood 140 includes a recirculation damper blade 146 used to block an air recirculation outlet 148 and a vent damper blade 150 used to block the air vent outlet 142. A damper blade linkage assembly 152 interconnects damper blades 146 and 150.

Damper blade linkage assembly 152 includes a link 154 extending between the recirculation damper blade 146 and a lever 156. A link 158 extends between vent damper blade 150 and lever 156. A handle member 160 ia interconnected to lever 156 and is operable between a rearmost position as shown in FIG. 7 and a forward position similar to the position of link 106 illustrated in FIG. 2.

FIG. 7 illustrates the summer mode of operation of hood 140 in which the recirculation damper blade 146 is closed and the vent damper blade 150 is open. The air flow pattern is designated by path 162, such that the warm air from the kitchen stove is vented through the vent outlet 142 exterior of the kitchen area. The damper blade linkage assembly 152 operates in a similar manner as to the damper blade linkage assembly 80 discussed in conjunction with FIGS. 2, 3 and 4. In the winter mode of operation, handle 160 is moved to its forward position, thereby simultaneously closing vent damper blade 150 and opening recirculation damper blade 146. An air flow path is therefore established through filters 66 and 68 through the recirculation outlet 148 to recirculate filtered warm air to the kitchen area.

Figure 8:
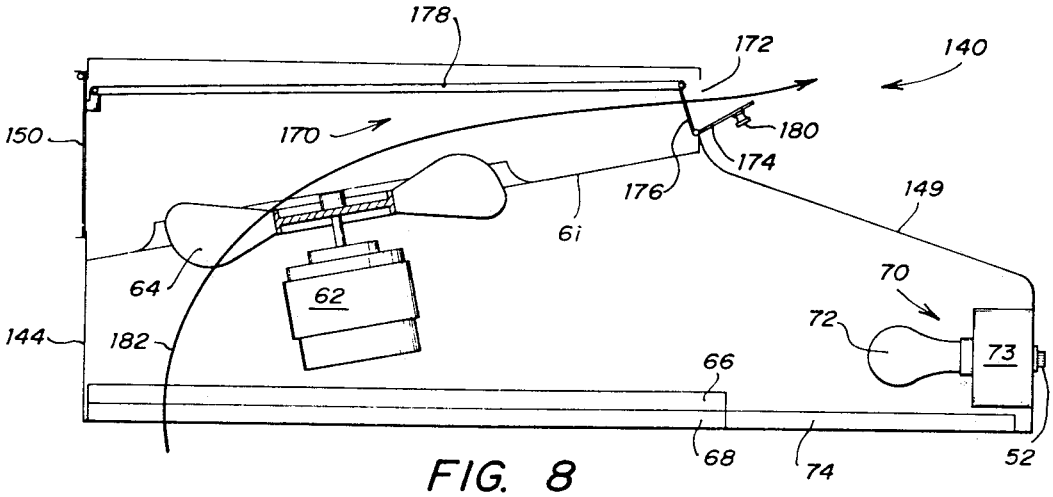
FIG. 8 is a side elevation view in section of the kitchen stove hood of FIG. 7 utilizing a third embodiment of the damper blade linkage assembly.

Referring to FIG. 8, kitchen hood 140 is illustrated utilizing a second embodiment of a damper blade linkage assembly generally referred to by the numeral 170. An air recirculation outlet 172 is located in the front portion 149 of kitchen hood 140. A recirculation damper blade 174 is mounted adjacent recirculation outlet 172. Recirculation damper blade 174 is rotatably mounted to a link 176, which in turn is rotatably mounted to a link 178. Link 178 is mounted to vent damper blade 150, which is mounted adjacent to vent outlet 142 (FIG. 7).

A handle 180 is mounted to recirculation damper blade 174 and is accessible to the operator to open and close the damper blades for the desired winter or summer mode of operation. FIG. 8 illustrates the winter mode of operation in which the air flow path 182 recirculates filtered air through air recirculation outlet 172 to the kitchen area. To place the kitchen hood in the summer mode of operation, the operator closes the damper recirculation blade 174 by pushing handle 180 rearwardly to block recirculation outlet 172. The closing of recirculation damper blade 174 laterally displaces link 178 rearwardly to open vent damper blade 150, which provides an air path through vent outlet 142 (FIG. 7).

Figure 9:
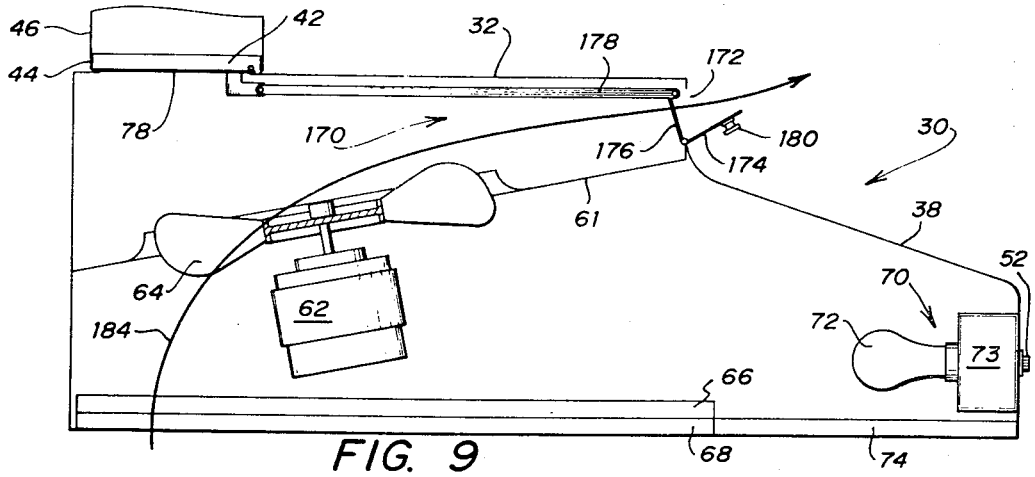
FIG. 9 is a side elevation view in section of the kitchen stove hood of FIG. 1 utilizing the third embodiment of the damper blade linkage assembly of FIG. 8.

FIG. 9 illustrates kitchen hood 30 embodying the damper blade linkage assembly 170 of FIG. 8. The winter mode of operation is illustrated, wherein the filtered warm air is recirculated to the kitchen area following the air flow path 184. The damper blade linkage assembly 170 operates in a manner similar to that discussed with respect to FIG. 8. In the summer mode of operation, the recirculation damper 174 will be closed and the vent outlet 42 will be opened, with the vent dampler blade 78 positioned as shown in FIG. 3.

Figure 10:
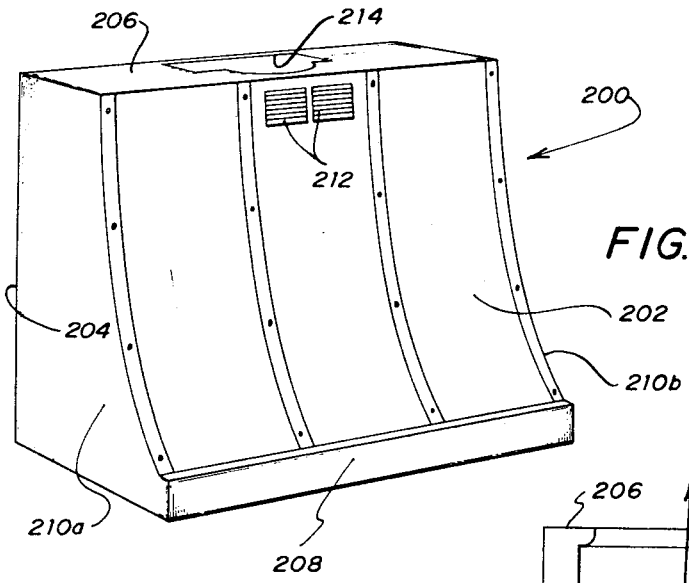
FIG. 10 is a perspective view of a third embodiment of a kitchen stove hood of the present invention.

Referring to FIG. 10, a third embodiment of the kitchen stove hood of the present invention is illustrated and generally referred to by the numeral 200. Kitchen hood 200 includes front and rear portions 202 and 204, top and bottom portions 206 and 208, and sides 210*a* and 210*b*. An air recirculation outlet 212 is located in the front portion 202 of kitchen hood 200 and an air vent outlet 214 is located in the top portion 206 of the hood 200.

Figure 11:
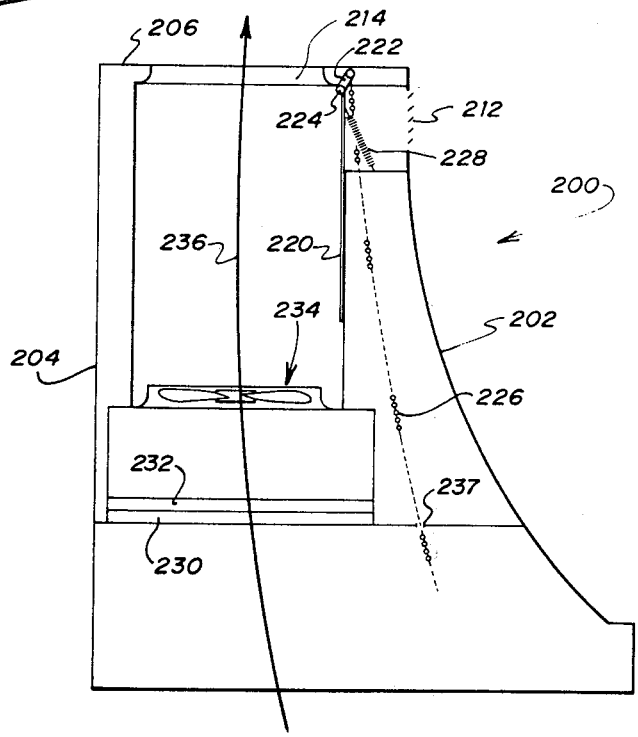
FIG. 11 is a side elevation view in section of the kitchen stove hood of FIG. 10 utilizing a first embodiment of a damper blade control illustrating the summer mode of operation.
Figure 12:
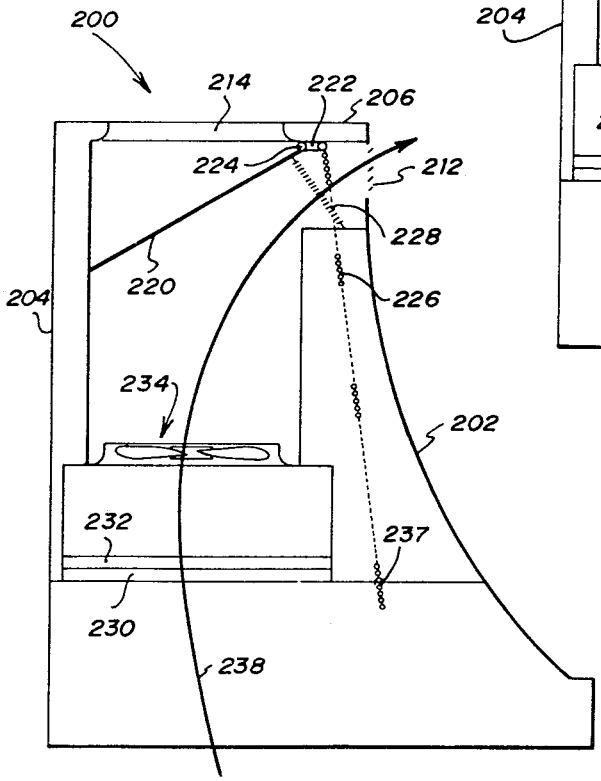
FIG. 12 is a side elevation view in section of the kitchen stove hood of FIG. 11 illustrating the winter mode of operation.

Referring simultaneously to FIGS. 11 and 12, wherein like numerals are used for like and corresponding elements, the interior of hood 200 is illustrated. The hood 200 includes a damper blade 220, which is movable between the summer mode of operation illustrated in FIG. 11 and the winter mode of operation illustrated in FIG. 12. Damper blade 220 is mounted to a lever arm 22, which in turn is mounted to a rod 224 attached to the interior of hood 200. The second end of lever arm 222 is attached to a chain 226. A spring 228 is attached between damper blade 220 and a point interior of kitchen hood 200.

In operation of hood 200, the spring 228 normally biases the damper blade 220 in the position shown in FIG. 11. In this position damper blade 220 blocks the recirculation outlet 212 and permits air to flow through filters 230 and 232, through a fan assembly 234 and to exit through the air vent outlet 214. The summer mode air flow pattern is illustrated by path 236.

To convert the kitchen hood 200 to the winter mode of operation (FIG. 12), the operator grasps the chain 226 and exerts a downwardly directed force. This force causes damper blade 220 to pivot about the rod 224 until the spring 228 is fully extended. To retain spring 228 in its extended position and the damper blade 220 in the position shown in FIG. 12, the lower end of chain 226 is inserted into a slot 237 formed in the interior of hood 200. The winter mode air flow pattern, path 238, recirculates warm filtered air through air recirculation outlet 212 to the kitchen area. To return the system to the summer mode of operation, the operator disengages the chain 226 from the slot 237 and under the influence of spring 228, damper blade 220 is returned to its normal position blocking air recirculation outlet 212.

Figure 13:
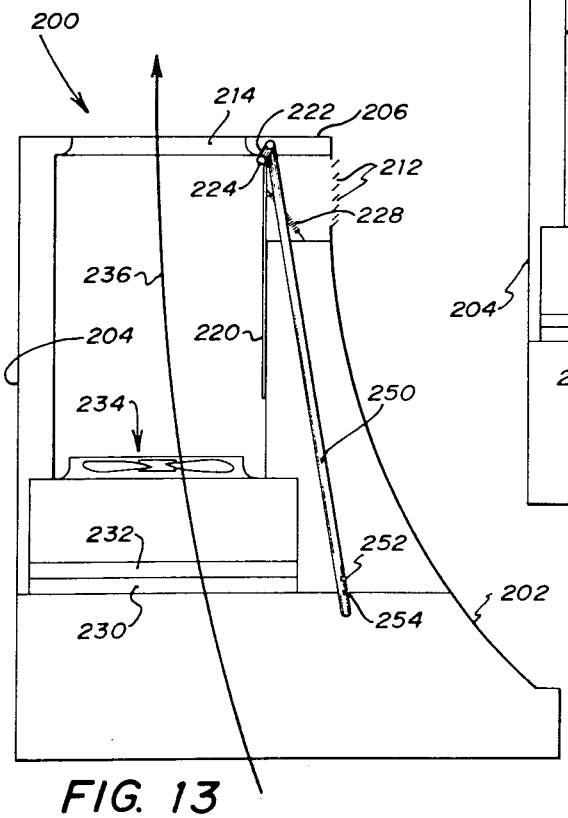
FIG. 13 is a side elevation view in section of the kitchen stove hood of FIG. 10 utilizing a second embodiment of the damper blade control illustrating the summer mode of operation.
Figure 14:
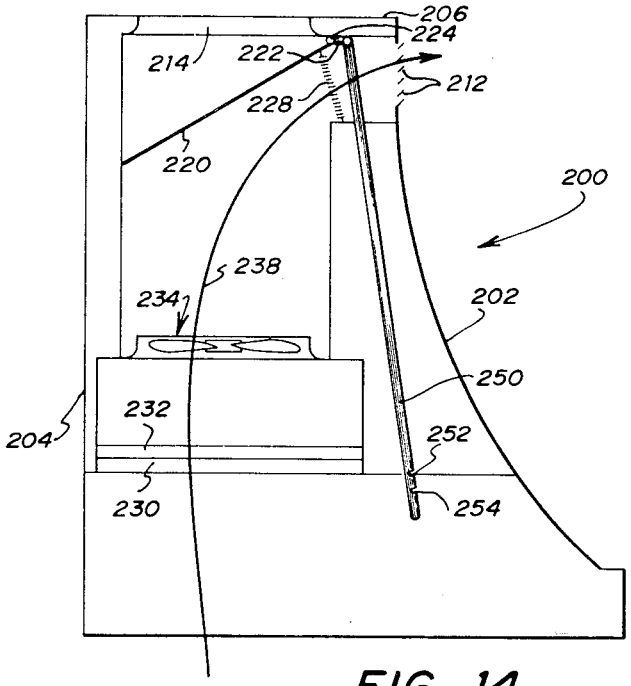
FIG. 14 is a side elevation view in section of the kitchen stove hood of FIG. 13 illustrating the winter mode of operation.

Referring simultaneously to FIGS. 13 and 14, wherein like numerals are used for like and corresponding elements, hood 200 is illustrated utilizing a second embodiment of a link 250. Link 250 is operable to move damper blade 220 from its summer position shown in FIG. 13 to the winter position as shown in FIG. 14. The upper end of link 250 is rotatably connected to lever arm 222 and is operable to pivot damper blade 220 about rod 224. The lower end of link 250 includes vertically spaced slots 252 and 254.

In the summer mode of operation shown in FIG. 13, slot 254 engages an interior portion of kitchen hood 200 and spring 228 biases damper blade 220 to block the air recirculation outlet 212. In this position, the air flows through filters 230 and 232 and exits through vent outlet 214 along path 236. To convert the kitchen hood 200 to the winter mode of operation (FIG. 14), the operator disengages slot 254 from the interior portion of hood 200 and engages slot 252 with the interior portion of hood 200. The damper blade 220 is then retained in the position shown in FIG. 14 with spring 228 extended under the influence of link 250. The resulting air flow pattern is indicated by the path 238 in which air is filtered by filters 230 and 232 and exits from the air recirculation outlet 212 into the kitchen area.

Figure 15:
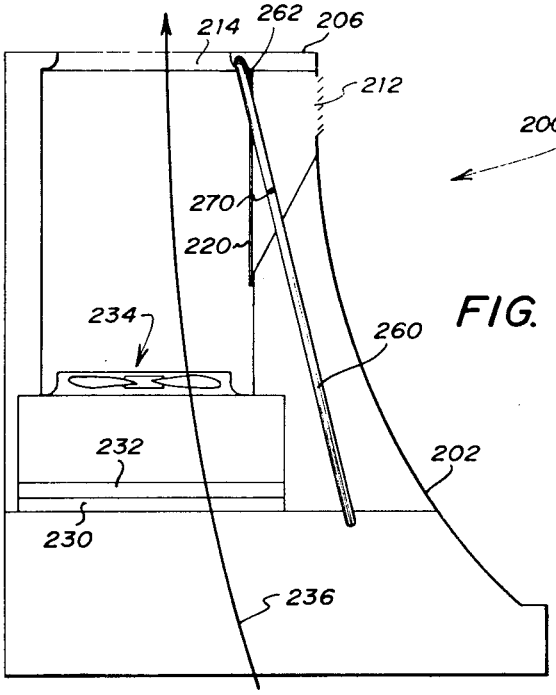
FIG. 15 is a side elevation view in section of the kitchen stove hood of FIG. 10 utilizing a third embodiment of a damper blade control illustrating the summer mode of operation.

Referring to FIG. 15, kitchen hood 200 is illustrated utilizing a third linkage embodiment to position damper blade 220. FIG. 15 illustrates the use of a link 260, which is rotatably connected to damper blade 220 by a crank 262. As is more clearly shown in FIG. 16, crank 262 is mounted to a shaft 266, which is supported by interior wall 268 of the hood 200. Link 260 is also connected at 270 to interior wall 268 for pivotal movement about point 270.

Figure 16:
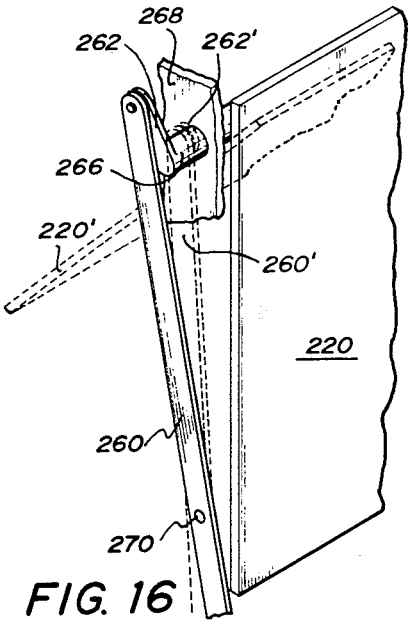
FIG. 16 is an enlarged perspective view of the damper blade control of FIG. 15.

To change the mode of operation from the summer mode (FIG. 15) to the winter mode (FIG. 16), the operator grasps the lower end of link 260 and pushes it rearwardly. This causes crank 262 to rotate from the position shown in FIGS. 15 and 16 to the position 262' shown in phantom in FIG. 16. FIG. 16 also illustrates the position of the damper blade 220 as 220' in the winter mode of operation.

Referring simultaneously to FIGS. 17 and 18, kitchen hood 200 is illustrated utilizing a fourth linkage embodiment to position damper blade 220. This embodiment utilizes a solenoid 300 to move damper blade 220 from the summer mode of operation illustrated in FIG. 17 to the winter mode of operation illustrated in FIG. 18. Solenoid 300 is rotatably connected to lever arm 222 and is mounted adjacent the air recirculation outlet 212. When the solenoid is in its deenergized state, spring 228 biases the damper blade 220 to block the air recirculation outlet 212. In this position, the air flow pattern indicated by path 236 flows through the filters 230 and 232 through the fan assembly 234 and exits through the air vent outlet 214.

Solenoid 300 is interconnected to a switch 302, which is also interconnected to the fan motor input terminals at 304. The fan motor is actuated by closing switch 302, using a push-button operator control 306 mounted on the front 202 of hood 200. An operator push-button control 308 is mounted in the interior of kitchen hood 200 and is accessible to the operator through the bottom portion of kitchen hood 200. Control 308 is electrically connected in series with switch 302, solenoid 300 and the fan motor. Upon actuation of push-button 306 which closes switch 302, push-button 308 can be depressed to energize solenoid 300. Solenoid 300 can only be energized when the fan motor is activated by the closing of switch 302.

When solenoid 300 is energized, the solenoid forces damper blade 220 to pivot about rod 224 until the damper blade 220 reaches its winter mode position as illustrated in FIG. 18. In this position, spring 228 is extended under the influence of solenoid 300. Damper blade 220 will automatically be returned to its normal position, shown in FIG. 17, when the fan motor is deactivated, because solenoid 300 will be deenergized. Damper blade 220 is returned to its normal position under the biasing force of spring 228.

Referring simultaneously to FIGS. 19, 20 and 21, a kitchen stove hood conversion kit is illustrated. The purpose of the kit is to permit configuration of a standard kitchen stove hood in either the summer or winter mode of operation. In this manner, a retail business need only stock standard housings, along with the present conversion kits. The retailer can then assemble a hood providing either ventilation, recirculation or a hood providing selectable ventilation or recirculation according to the present invention. The kit includes a housing 350 and a cylindrical member 354. The housing 350 is installed to the top rectangular plate 352 of a kitchen stove hood represented by hood 356 shown in FIG. 19. Hood 356 includes an air intake opening in its lower portion 358, a front recirculation outlet included in the front portion 360 and an upper vent outlet included in the upper portion 362.

Referring simultaneously to FIGS. 20 and 21, the housing 350 includes a front wall 364 and side walls 368 and 370. The fourth side of housing 350 includes an aperture 372. The top 374 of housing 350 includes a circular aperture 376 dimensioned to receive cylinder 354. Housing 350 further includes a bottom 378. The top rectangular plate 352 of hood 356 has ends **352*a* and 352*b* and includes an aperture 380, which includes a rectangular portion 380*a* and a circular portion 380*b***.

To install the kit for a permanent recirculation mode of operation, housing 350 is attached to plate 352 using screws 390 as illustrated in FIG. 21. Cylinder 354 is mated with aperture 376 of housing 350. The aperture 372 of housing 350 is then aligned with the air recirculation vent contained in the front 360 of hood 356 and plate 352 is secured to hood 356 using screws 392 as illustrated in FIG. 19. In this manner, the bottom 378 of housing 350 blocks the aperture 380 in the rectangular plate 352. The air therefore flows from the air intake opening at 358 up through cylinder 354 and out aperture 372 in housing 350 through the air recirculation vent located in front side 360 of hood 356.

To construct the kitchen hood kit for a permanent ventilation mode of operation, the housing 350 is not installed. For installation, the cylindrical member 354 is mated with the circular aperture **380*b* contained in the rectangular plate 352. Cylinder 354 thus blocks the air recirculation outlet contained in the front wall 360 of hood 356 and creates a direct air flow path between the air intake opening at 358 and the aperture 380*b* contained in rectangular plate 352. Aperture 380*b* would function as an air vent outlet similar to air vent outlet 214 in kitchen hood 200 (FIGS. 17 and 18**).

The present kitchen hood kit provides an inexpensive kitchen hood using standardized elements to construct a hood having a permanent recirculation or ventilation mode of operation. The kit permits easy installation, which can be performed on the job site. The hood kit also utilizes less storage space and is cheaper to ship than a completed hood.

Referring simultaneously to FIGS. 22 and 23, a second embodiment of the kitchen hood kit is illustrated which provides selective recirculation or ventilation modes. A housing 400 is installed in kitchen hood 356 and is operable in either the winter or summer modes. Housing 400 includes an air recirculation outlet 402 and an air vent outlet 404. The housing 400 also includes a damper blade 406 shown in FIG. 23 in the summer mode of operation, blocking the air recirculation outlet 402. The damper blade 406 is interconnected to a linkage assembly 408, which is operable to move the damper blade 406 between the summer mode of operation shown in FIG. 23 and the winter mode of operation in which damper blade 406 blocks air vent outlet 404.

The operation of linkage assembly 402 is similar to that illustrated and described in connection with FIGS. 13 and 14. To install the housing 400 in the kitchen hood 356, the recirculation outlet 402 is aligned with the air recirculation outlet contained in the front portion 360 of hood 356 and the air vent outlet 404 of housing 400 is aligned with aperture **380*b* of rectangular plate 352. Housing 400 is secured to hood 356 using screws or welds along flanges 410. The use of housing 400 therefore provides a third alternative to the kit described in connection with FIGS. 19, 20 and 21** to construct a kitchen hood which functions in both the winter and summer modes of operation.

Referring simultaneously to FIGS 24–27, wherein like numerals are used for like and corresponding elements throughout, a third embodiment of the kitchen stove hood conversion kit is illustrated, which provides for permanent recirculation or ventilation modes of operation. The kit includes a standard kitchen stove hood 500 having an upper portion 502, lower portion 504, front portion 506 and a rear portion 508.

Hood 500 further includes a fan assembly 510, which is activated by a motor speed control switch 512 mounted on the front portion 506 of hood 500. A fan 510 draws air from the kitchen area through filters 514 and 516 to either recirculate air to the kitchen area or vent air from the kitchen area depending upon the permanent mode of operation selected. Located in the front portion 506 of hood 500 is an air recirculation outlet 518. The upper portion 502 includes an upper vent outlet 520 and the rear portion 508 of hood 500 includes a rear vent outlet 522.

Figure 24:
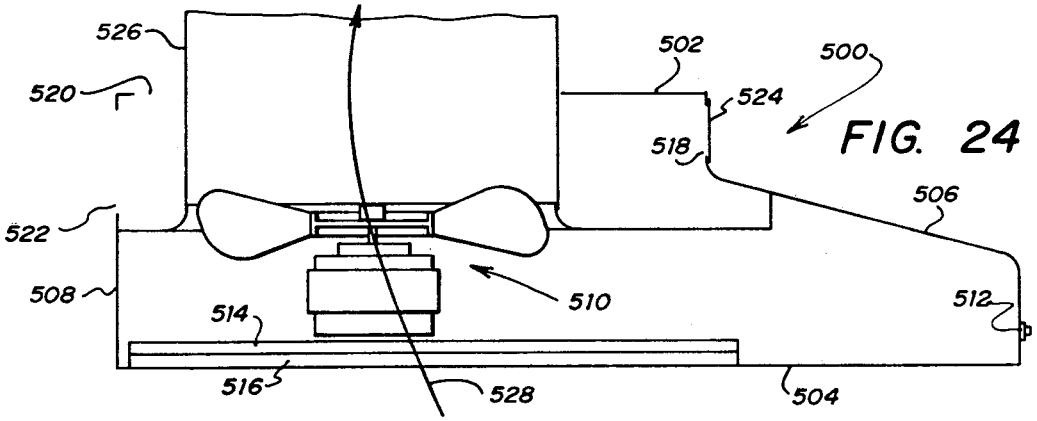
FIG. 24 is a side elevation view in section of a third embodiment of a kitchen stove hood conversion kit illustrating a permanent ventilation mode of operation.

Referring to FIG. 24, hood 500 is illustrated in the permanent ventilation mode of operation in which air is vented from the kitchen area. The first element of the conversion kit of the present invention includes a vent cover 524 shown mounted to the front portion 506 of hood 500 to block the front recirculation outlet 518. A cylindrical duct 526 comprises part of the exhaust ventilation ductwork of the kitchen and is mounted within hood 500 to extend from fan 510 through the upper vent outlet 520 in upper portion 502 of hood 500. Cylindrical duct 526 blocks the rear vent outlet 522 and creates a direct air flow path 528 between the air intake opening in the lower portion 504 and the upper vent outlet 520.

Figure 25:
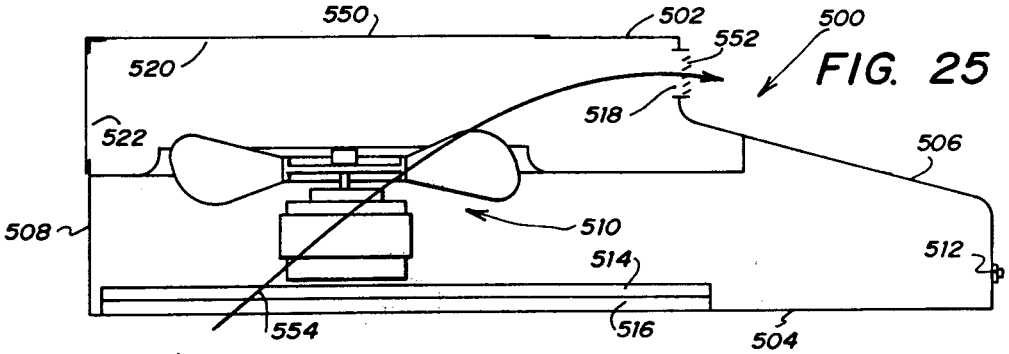
FIG. 25 is a side elevation view in section of the conversion kit shown in FIG. 24 illustrating the permanent recirculation mode of operation.

Referring to FIG. 25, hood 500 is illustrated in the permanent recirculation mode of operation utilizing two additional elements of the conversion kit. A cover member 550 extends and is mounted along the upper portion 502 and the rear portion 508 of hood 500 to block the upper vent outlet 520 and rear vent outlet 522. The vent cover 524 of the conversion kit configuration shown in FIG. 24 is not installed. In place of vent cover 524 a louvered vent panel 552 has been inserted in the front portion 506 of hood 500. Utilizing conversion kit elements 550 and 552 a direct air flow path 554 is created between the air intake opening in the lower portion 504 and the air recirculation outlet 518 to return warm filtered air to the kitchen area.

Figure 26:
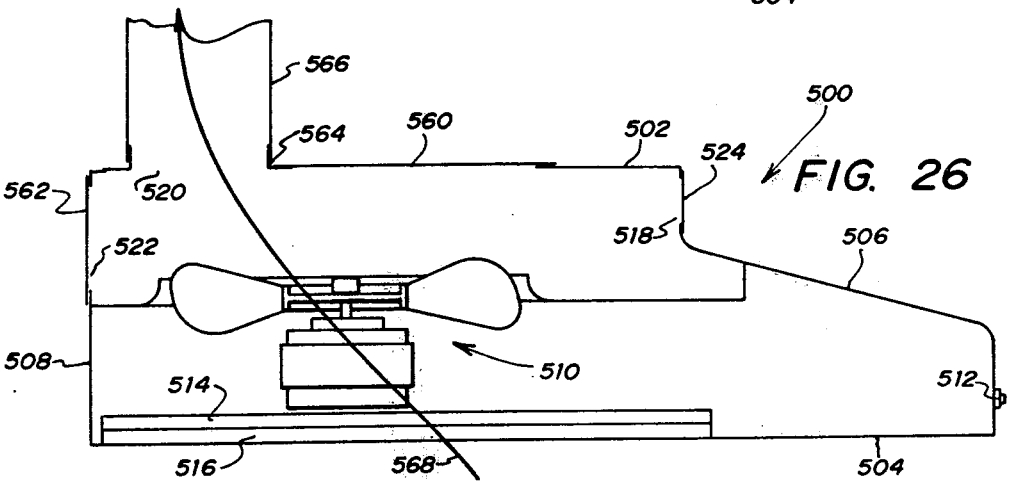
FIG. 26 is a side elevation view in section of the conversion kit shown in FIG. 24 illustrating a second permanent ventilation mode of operation.

Referring to FIG. 26, three additional elements to the conversion kit are illustrated. These three elements include a rectangular plate 560, a rectangular plate 562, and a rectangular damper 564. Rectangular plate 560 is mounted to block the upper vent outlet 520 located in the upper portion 502 of hood 500. The rectangular plate 562 is mounted to block the rear vent outlet 522 located in the rear portion 508 of hood 500. The damper 564 is mounted to plate 560 and to the upper portion 502. Damper 504 is interconnected to the external kitchen ductwork such as duct 566 for venting air from the kitchen area. Vent cover 524 is mounted to front portion 502 as in FIG. 24.

FIG. 26 illustrates the use of the kitchen stove hood conversion kit to permit construction of hood 500 in the permanent ventilation mode of operation. The air flow pattern follows path 568 in which air flows from the air intake opening at 504 to the upper vent outlet 520 contained in the upper portion 502 of hood 500. To convert the kitchen hood of FIG. 26 to receive a cylindrical duct such as duct 526 shown in FIG. 24, the kit elements 560 and 564 of FIG. 26 are removed.

Figure 27:
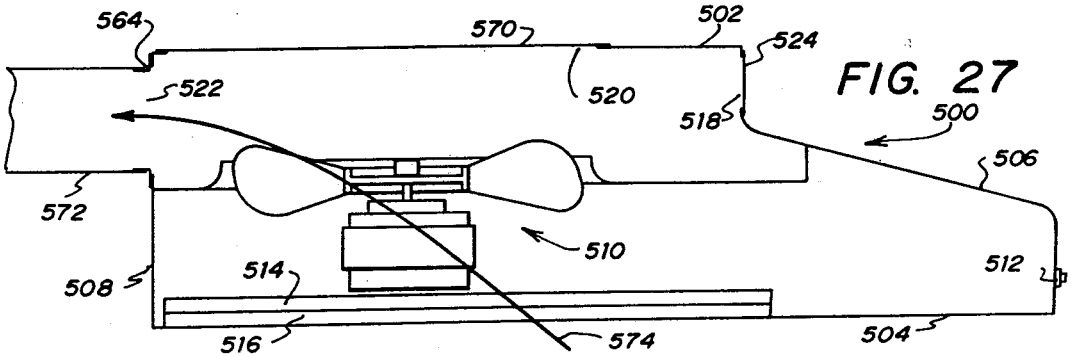
FIG. 27 is a side elevation view in section of the conversion kit shown in FIG. 24 illustrating a third permanent ventilation mode of operation.

Referring to FIG. 27, the final element of the kitchen stove hood conversion kit is illustrated. To convert the kitchen hood of FIG. 26 from an upper duct connection to a rear duct connection shown in FIG. 27, a plate 570 is utilized to block the upper vent outlet 520 in the upper portion 502 of hood 500. The damper 564 is then mounted to the rear portion 508 of hood 500 and is aligned with rear vent outlet 522. Damper 564 can then be interconnected to the kitchen ductwork 572 to vent heated air from the kitchen area. FIG. 27 as does FIG. 26 illustrates the permanent ventilation mode of operation in which the heated air follows path 574. Air flows in from the air intake opening at 504 and out through the rear vent outlet 522 in the rear portion 508 of hood 500.

In summary, the third embodiment of the kitchen stove hood conversion kit includes the standard kitchen stove hood 500, vent cover 524, louvered panel 522, cover member 550, damper 564 and plates 560, 562 and 570. Utilizing one or more of these elements, the standard hood 50 can be constructed in either the permanent recirculation or ventilation mode of operation. Three different configurations illustrated in FIGS. 24, 26 and 27 of the permanent ventilation mode of operation are possible utilizing the conversion kit.

It will thus been seen that the present invention provides a kitchen stove hood that includes two venting modes. One mode allows hot air to flow from the kitchen stove through a filter to a vent outlet to remove hot air from the kitchen area and thereby providing a cooling effect during the summer months. The second mode of operation permits warm air from the kitchen stove to be filtered and recirculated into the kitchen area to save energy during the winter months.

Whereas the present invention has been described with respect to specific embodiments thereto, it will be understood that various changes and modifications will be suggested to one skilled in the art and it is intended to encompass such changes and modifications which fall within the scope of the appended claims.

What is claimed is:

1. A kitchen stove hood for selectively providing air ventilation or recirculation in a kitchen area comprising:

a hood dimensioned to be disposed in the kitchen area over a stove and having top, bottom, sides, back and front portions;

said hood including an air intake opening at said bottom portion;

a fan for causing air from the kitchen area to flow through said air intake opening;

an air recirculation outlet in said hood for recirculating air to the kitchen;

an air vent outlet in said hood for venting air from the kitchen;

a damper blade mounted for movement between a first position adjacent said recirculation outlet and a second position adjacent said vent outlet for selectively opening and closing said outlets;

spring means for normally biasing said damper blade in said first position adjacent said recirculation outlet;

a solenoid operable between an extended and retracted position to relatively extend and retract said spring, such that upon energization said solenoid is extended to extend said spring and to move said damper blade to said second position and upon deenergization said solenoid is retracted to compress said spring and to move said damper blade to said first position; and means for actuating said solenoid.

2. The kitchen stove hood of claim 1 wherein said solenoid activating means comprises electric switch means accessible to the operator.

* * * * *

UNITED STATES PATENT AND TRADEMARK OFFICE

CERTIFICATE OF CORRECTION

PATENT NO. : 4,121,569

DATED : October 24, 1978

INVENTOR(S) : Leon O. Bowen, Jr. and Michael T. McVean

It is certified that error appears in the above-identified patent and that said Letters Patent are hereby corrected as shown below:

Column 1, line 22, change "every" to --easy--;
Column 6, line 3, change "dampr" to --damper--;
Column 6, line 28, change "ia" to --is--;
Column 7, line 12, change "dampler" to --damper--;
Column 7, line 30, change "22" to --222--;
Column 11, line 37, change "50" to --500--.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*